United States Patent [19]

Carroll et al.

[11] Patent Number: 4,470,627

[45] Date of Patent: Sep. 11, 1984

[54] PORTABLE LEAF AND TRASH COLLECTOR

[76] Inventors: George J. Carroll; Mamie M. Carroll, both of P.O. Box 12, Crownsville, Md. 21032

[21] Appl. No.: 420,335

[22] Filed: Sep. 20, 1982

[51] Int. Cl.[3] ..... B65B 67/12

[52] U.S. Cl. ..... 294/55; 15/257.1; 141/108; 141/391; 248/101; 294/1 B

[58] Field of Search ..... 294/1 R, 1 B, 1 BA, 294/55; 15/104.8, 257.1; 141/108, 109, 313, 314, 341, 390, 391; 248/99, 101

[56] References Cited

U.S. PATENT DOCUMENTS

| | | | |
|---|---|---|---|
| 133,562 | 12/1872 | Chaffin | 141/391 X |
| 571,513 | 11/1896 | Davidson | 141/108 |
| 1,953,042 | 3/1934 | Cody | 248/101 X |
| 2,827,931 | 3/1958 | Melvin . | |
| 3,818,956 | 6/1974 | Chamberlain . | |
| 3,893,649 | 7/1975 | Cornell et al. . | |
| 3,910,619 | 10/1975 | Schmieler | 294/55 X |
| 3,936,087 | 2/1976 | Alexander . | |
| 3,942,832 | 3/1976 | Haas, Jr. . | |
| 4,014,157 | 3/1977 | Pearce | 141/390 X |
| 4,133,356 | 1/1979 | Dillingham . | |
| 4,139,029 | 2/1979 | Geraci . | |
| 4,248,278 | 2/1981 | Blodgett . | |
| 4,312,531 | 1/1982 | Cross . | |

*Primary Examiner*—Johnny D. Cherry

*Attorney, Agent, or Firm*—Schwartz, Jeffery, Schwaab, Mack, Blumenthal & Koch

[57] ABSTRACT

The portable leaf and trash collector according to the invention includes a first member with a chute portion on one end, a scoop on the other end, and a groove between the chute and scoop. The chute portion is inserted into the top opening of a plastic bag, and the bag is surrounded by a ring with a handle thereon. The handle is positioned so that it is approximately opposite the chute and the bag is retained between the ring and first member by snapping the ring into the groove.

5 Claims, 3 Drawing Figures

PORTABLE LEAF AND TRASH COLLECTOR

BACKGROUND OF THE INVENTION

1. Field of the Invention

The invention relates to a leaf and trash collector and a method of collecting same. More particularly, the invention relates to a method and apparatus for inserting a chute into a plastic bag and retaining the chute within the bag, and filling the bag.

2. Prior Art

It is difficult when filling a plastic leaf, trash bag or the like with debris to retain the bag in an open position while inserting leaves and other trash therein. Various devices have been provided, including stands for retaining the bag in an open, upright position. Such stands have proved to have disadvantages in having to pick the leaves and trash up to insert them in the bag opening, as well as the bag coming off of the retainer.

Leaf collectors such as illustrated in U.S. Pat. No. 3,942,832 have been provided wherein a rim with a handle therein retains a plastic leaf bag in an open position. An elongated elastic restraining member is used to cooperate with a groove in the rim to retain the bag on the rim. However, the bag can easily pull off the rim because the elastic member does not provide a sufficient gripping force. Also, the weight of the entire assembly is supported by a handle on the rim which, in turn, does not provide any assistance in retaining the bag on the rim.

U.S. Pat. No. 3,893,649 illustrates another bag holder wherein a plastic frame ring is provided and wherein a plastic bag is folded thereover. A supplemental retainer ring having a pair of free ends and a circumferential groove is snapped into the initial frame ring to retain the bag therebetween. As with the previously discussed patent, there is no scoop means to assist in the insertion of leaves and trash into the bag. Further, with U.S. Pat. No. 3,893,649, there is no means to hold the bag while trash is being inserted. Also, because of the split nature of the supplemental retainer ring, the plastic bag can easily slip out when full. On the other hand, there is no great need to retain the bag in the combination rings since one would presumably not carry or move the bag or even retain or hold the bag by use of the rings.

The following patents also illustrate bag and receptacle filling means, including means for having a scoop and/or chute combination: U.S. Pat. Nos. 2,827,931, 3,818,956, 3,936,087, 4,133,356, 4,139,029, 4,248,278 and 4,312,531.

OBJECTS AND SUMMARY OF THE INVENTION

It is an object of the instant invention to provide a combined means and method for holding a bag in the open position for inserting leaves, lawn clippings and the like, together with means for holding the device and having the scoop for assisting in filling the bag.

Another object is to provide a two-piece member with a handle in such a way that there is less pressure on the retaining ring, thus providing a better means for holding the bag on the device.

Still another object is to provide an easy to use leaf collector assembly and method.

The portable leaf and trash collector according to the invention includes a first member with a chute portion on one end, a scoop on the other end, and a groove between the chute and scoop. The chute portion is inserted into the top opening of a plastic bag, and the bag is surrounded by a ring with a handle thereon. The handle is positioned so that it is approximately opposite the chute, and the bag is retained between the ring and first member by snapping the ring into the groove.

BRIEF DESCRIPTION OF THE DRAWINGS

The above and other objects and advantages of the present invention will become apparent from the following description and accompanying drawings werein.

DETAILED DESCRIPTION OF THE INVENTION

Figure 1:
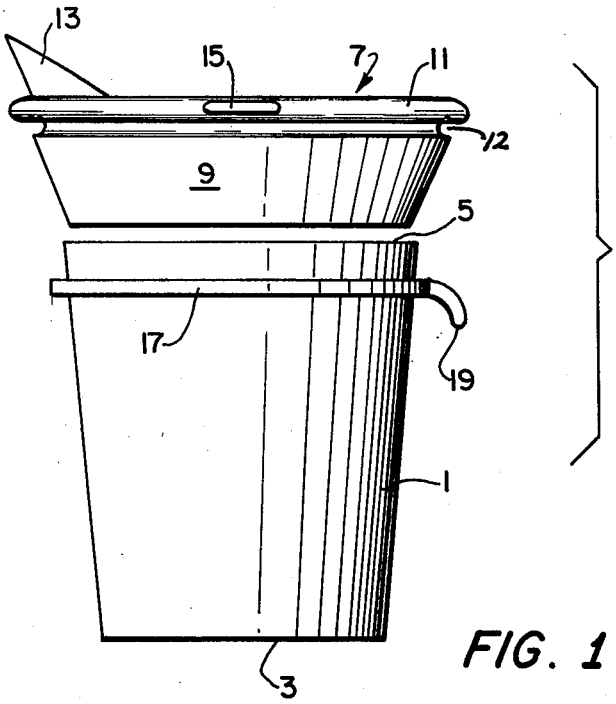
FIG. 1 is an exploded side elevation view of the portable leaf and trash collector.

Referring to FIG. 1, a plastic bag of conventional design is seen at 1. The bag has a bottom 3 and a top opening at 5. The bag is opened and a first member 7 having a downwardly tapered chute 9 at the bottom forming an opening 10 is inserted therein. The first member also has a circumferential lip 11 and a groove 12 therein at the top portion thereof. Extending from one side of the lip 11 is the chute 9. Finally, approximately 90° in either direction from the chute 9 are a pair of carrying handles 15.

Figure 2:
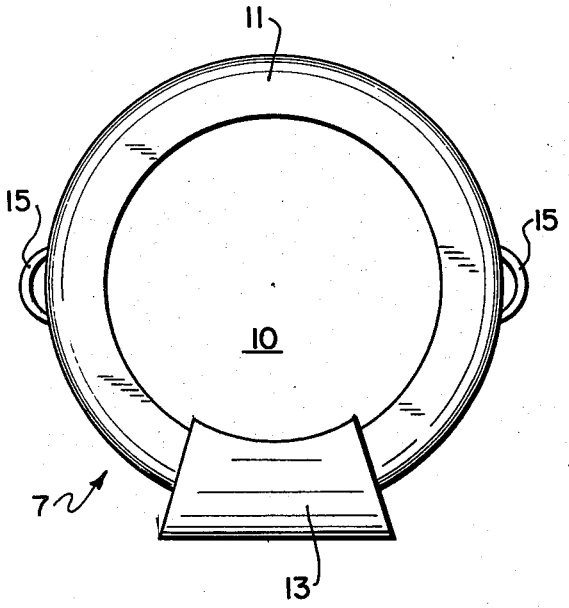
FIG. 2 is a front elevation view of the chute member.

The chute can also be seen from a front view in FIG. 2. It is contemplated that the chute will be made of a rigid injected molded plastic material of sufficient rigidity to retain the bag in the open position, as well as acting as an assist by means of a scoop 13 to permit material in the form of leaves and trash to be inserted therein. The scoop 13 extends about 90° or slightly less around the periphery of lip 11.

Figure 3:
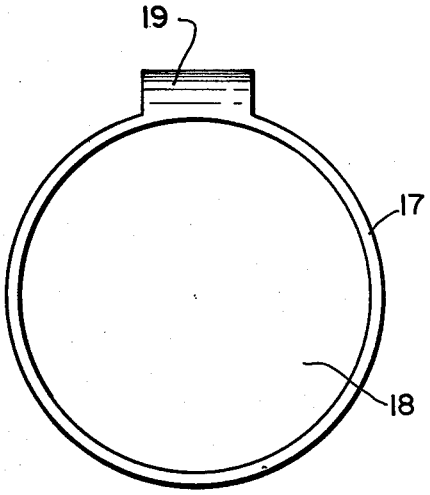
FIG. 3 is a front elevation view of the ring member.

A ring 17 having an opening 18 and a stabilizing handle 19 formed of metal, hard rubber or other substantially rigid nonelastic material cooperates with the bag 1 and groove 12. The ring can been seen in a front view in FIG. 3.

OPERATION

The leaf and trash collector and method of the instant invention is performed by, for example, placing the plastic bag 1 within opening 18 of plastic ring 17 with the opening 5 of the bag extending slightly above the top of ring 17. The bag 5 is opened and chute 9 of member 7 is inserted within the opening. The combined bag and ring 17 are slid up over the tapered portions of the chute 9 until the ring 17, together with the bag, are forced into or snapped into groove 12. There is provided, of course, sufficient resilience between the ring and member 7 to permit the ring to snap in and out of groove 12, yet the ring is not sufficiently elastic to permit it to be easily dislodged from the groove.

In positioning the handle 19 relative to the scoop 13, the two will be approximately 180° from each other as seen in FIG. 1. In this way, it will be possible for the user to rotate the combined bag and members 7 and 17 counterclockwise 90° from that shown in FIG. 1 so that scoop 13 rests on the ground, and the combined unit can be held by handle 19. In this way, scoop 16 can be used as a "scoop" so that the leaves or other trash will enter into the center opening 10 in chute 9 and proceed to the interior of plastic bag 1.

When the plastic bag 1 is sufficiently filled, the members 7 and 17 are disengaged by unsnapping ring 17 from groove 12 and pulling chute 9 out from the interior of the bag. Ring 17 can either be removed from the top of the bag or can be permitted to fall onto the ground. The bag is then neatly tied closed.

Obviously, the bag can be moved from place to place in a semi-filled condition by use of handles 15 or by the primary use of handle 19.

While an embodiment of the invention has been described, it will be understood that it is capable of still further modification and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A portable leaf and trash collector comprising:

(a) a first member for inserting into a flexible plastic trash bag or the like, said first member having:

(1) a top portion and a bottom portion, (2) a substantially annular, inwardly tapered chute on the bottom portion, said chute extending into the bag, (3) a substantially annular lip on the top portion, (4) a substantially annular groove between said chute and said lip, (5) a scoop extending outwardly from said lip, (6) a pair of carrying handles adapted to be positioned about 90° from said chute;

(b) a second member in the form of a ring inserted into said groove;

(c) a stabilizing handle on said second member adapted to be positioned approximately opposite said chute;

2. A collector as defined in claim 1 wherein said scoop extends less than about 180° around said lip.

3. A collector as defined in claim 1, wherein said scoop extends less than about 90° around said lip.

4. A collector as defined in claim 1 wherein said ring is substantially rigid and nonelastic.

5. A method of collecting leaves, trash and the like comprising:

(a) providing a flexible plastic trash bag or the like for filling;

(b) providing a first member with an annular, inwardly tapered chute portion on one end, a scoop on the other end, and a groove between said chute and said scoop and a pair of handles thereon;

(c) inserting said chute portion into the top opening of the bag;

(d) providing a second member in the form of a ring with a handle thereon, surrounding the bag with said ring wherein said handle is positioned approximately opposite said chute;

(e) bending the top of the bag over at least a portion of said ring; and (f) retaining the bag between said ring and said groove.

* * * * *